US008752484B2

(12) United States Patent
Burczynski

(10) Patent No.: US 8,752,484 B2
(45) Date of Patent: Jun. 17, 2014

(54) THREE COMPONENT BULLET WITH CORE RETENTION FEATURE AND METHOD OF MANUFACTURING THE BULLET

(75) Inventor: Thomas J. Burczynski, Montour Falls, NY (US)

(73) Assignee: RA Brands, L.L.C., Madison, NC (US)

( * ) Notice: Subject to any disclaimer, the term of this patent is extended or adjusted under 35 U.S.C. 154(b) by 111 days.

(21) Appl. No.: 13/190,972

(22) Filed: Jul. 26, 2011

(65) Prior Publication Data

US 2013/0025490 A1 Jan. 31, 2013

(51) Int. Cl.

| | |
|---|---|
| ***F42B 14/02*** | (2006.01) |
| ***F42B 12/78*** | (2006.01) |
| ***F42B 30/02*** | (2006.01) |
| ***F42B 33/00*** | (2006.01) |

(52) U.S. Cl.
USPC ..... 102/439; 102/514; 86/55

(58) Field of Classification Search
USPC ..... 102/439, 514; 86/55
See application file for complete search history.

(56) References Cited

U.S. PATENT DOCUMENTS

| | | | | |
|---|---|---|---|---|
| 1,081,616 A | | 12/1913 | Johnson | |
| 2,696,130 A | | 12/1954 | Peters | |
| 4,044,679 A | * | 8/1977 | Pagano et al. | 102/517 |
| 4,108,073 A | | 8/1978 | Davis | |
| 4,336,756 A | * | 6/1982 | Schreiber | 102/516 |
| 4,870,884 A | * | 10/1989 | Schubart et al. | 86/20.12 |
| 5,357,866 A | * | 10/1994 | Schluckebier et al. | 102/509 |
| 6,119,600 A | * | 9/2000 | Burri | 102/518 |
| 6,213,022 B1 | | 4/2001 | Pullum | |
| 7,874,253 B2 | | 1/2011 | Marx | |
| 2006/0027128 A1 | | 2/2006 | Hober | |

(Continued)

FOREIGN PATENT DOCUMENTS

| | | |
|---|---|---|
| DE | 648039 C | 7/1937 |
| DE | 705504 C | 4/1941 |

(Continued)

OTHER PUBLICATIONS

Sharpe, Philp Burdette, "Complete Guide to Handloading", pp. 41-43, third edition, Wolfe Pub Co., 1988.

(Continued)

*Primary Examiner* — Bret Hayes
(74) *Attorney, Agent, or Firm* — Womble Carlyle Sandridge & Rice, LLP

(57) ABSTRACT

A three component bullet with an improved core retention feature and a method of manufacturing the bullet is described including a cylindrical jacket having an open end and a closed end containing a malleable metal core which is forced into a forming die having a bottleneck shaped interior resulting in a bottleneck shaped pre-form wherein the outside diameter of the open-ended forward portion of the jacket is smaller than the outside diameter of its closed rearward portion. The open end of the pre-form may be dropped through or forced through a malleable locking band of appropriate height, diameter and wall thickness. A relatively tight-fitting punch enters the open end of the pre-form generating sufficient axial force against the face of the metal core to radially swell the core and subsequently portions of the jacket fore and aft of the locking band, thereby securing the locking band in place while at the same time producing an inwardly-extending annular band of jacket material which embeds itself into the core material with the result that the core is permanently locked inside the jacket.

27 Claims, 10 Drawing Sheets

(56) References Cited

U.S. PATENT DOCUMENTS

| | | | | |
|---|---|---|---|---|
| 2007/0204758 | A1* | 9/2007 | Spatz et al. | 102/514 |
| 2010/0263565 | A1* | 10/2010 | Hugus et al. | 102/364 |
| 2011/0088537 | A1* | 4/2011 | Eberhart | 86/55 |
| 2011/0252997 | A1* | 10/2011 | Hoffman | 102/439 |

FOREIGN PATENT DOCUMENTS

| | | | |
|---|---|---|---|
| DE | 743914 | C | 1/1944 |
| DE | 2064553 | A1 | 7/1972 |
| EP | 0225532 | A1 | 6/1987 |
| EP | 0918208 | A1 | 5/1999 |
| GB | 191300326 | A | 1/1914 |
| WO | WO/2013/016330 | | 1/2013 |

OTHER PUBLICATIONS

International Search Report for PCT/US2012/047966 dated Oct. 16, 2012.

Written Opinion for PCT/US2012/047966 dated Oct. 16, 2012.

George C. Lambert, letter to Mr. C. V. Bracher regarding "Belted Bullet", Mar. 4, 1936, 2 pages, Peters Cartridge Division of Remington Arms Co., Inc., Bridgeport, CT.

Maj. George Nonte, Tip to Tip, Handloader: The Journal of Ammunition Reloading, Jul.-Aug. 1976, pages cover, 4, 12-13, Issue 62, Wolfe Publishing Company, Inc., Prescott, AZ.

Don Roberts, At Last! Pressure Data for the .30-40 Krag, Handloader: The Journal of Ammunition Reloading, Jul.-Aug. 1976, pages cover, 4, 38-41, Issuer 62, Wolfe Publishing Company, Inc., Prescott, AZ.

Photograph of .30 U.S. Govt. 1906—180 GRA . . . ; Scientific Bullet Design Ins . . . Superfine Accuracy; and Heavy Jacket Re-Inforced by Belt.

International Search Report dated Apr. 17, 2014 for International Application No. PCT/US2014/012952 filed Jan. 24, 2014.

Written Opinion dated Apr. 17, 2014 for International Application No. PCT/US2014/012952 filed Jan. 24, 2014.

* cited by examiner

THREE COMPONENT BULLET WITH CORE RETENTION FEATURE AND METHOD OF MANUFACTURING THE BULLET

BACKGROUND

1. Field of the Disclosure

This disclosure relates generally to a jacketed bullet which utilizes a core-retaining feature within the jacket and a method of making the bullet and, more specifically, this disclosure relates to a three component bullet having an external locking band which ultimately forms a core-locking feature within the interior of the jacket such that the core remains locked within the jacket even after impact with a hard barrier material such as windshield glass or sheet steel, for example.

2. Related Art

In order for a bullet to achieve optimum terminal performance, its jacket and core must penetrate a target as a single unit and remain connected throughout the course of travel, regardless of the resistance offered by the target material.

Various attempts have been made over the years to keep a bullet's jacket and core coupled together on impact. One of the earliest and simplest attempts utilized a knurling method which created a "cannelure" in a jacketed bullet. A cannelure typically includes a narrow, 360° circumferential depression in the shank portion of the bullet jacket. While the cannelure was originally conceived for use as a crimping feature, various companies have attempted to use it as both a crimping groove and as a core retaining feature, or solely as a core retaining feature. The knurling process forces jacket material radially inwardly, subsequently creating a shallow internal protrusion which extends a short distance into the bullet core. This approach has generally proven ineffective in keeping the core and jacket together, primarily due to the limited radial depth involved and the minimal amount of longitudinal core-gripping area that a cannelure offers. Upon impact with a hard barrier material, the core tends to immediately extrude beyond the confines of the inner protrusion, subsequently sliding out of the jacket. Depending on jacket wall thickness, core hardness and impact energy, axial core movement can actually "iron out" the internal geometry of the cannelure as the core slides forward. Even multiple cannelures have proven ineffective due to the inadequate amount of square area they are collectively able to cover.

U.S. Pat. No. 4,336,756 (Schreiber) describes a "two-component bullet" intended for hunting which comprises a cold worked jacket utilizing a narrow, inwardly-extending annular ring of jacket material terminating in a "knife-like edge" which is formed from a thickened portion of the jacket wall and which engages and holds the base of the core within the jacket after the bullet is final formed. U.S. Pat. No. 4,856,160 (Habbe, et al.) also describes a "two-component bullet" utilizing a reverse taper on the rearward interior of the jacket to lock the core within the jacket.

Other attempts at retaining the core within the jacket have been used in the past which do not utilize an external locking band. Such attempts range from providing a "partition" separating a rear core from a front core, electroplating a copper skin around the core prior to final forming the bullet, and heat-bonding (or similar heat treatment) the core to the interior of the jacket wall after the bullet is final formed. Each of these methods has shortcomings. The shortcomings typically include one or more of the following: (a) Jacket-core eccentricity resulting in less than desirable accuracy due to bullet imbalance, (b) slow manufacture, (c) high cost, and/or (d) less reliable.

With respect to the use of an external "band" in the construction of a projectile, U.S. Pat. No. 4,108,073 (Davis) describes an armor piercing projectile having a "rotating band" which is positioned around the outer surface of the jacket near the rearward end of the projectile. The diameter of the rotating band is larger than the diameter of the jacket. The rotating band serves to impart rotation to the projectile as it passes through the gun bore and seals hot gasses within the bore. The band typically includes plastic, gilding metal, sintered iron or other well known rotating band material. The Davis patent as cited herein should be viewed as general information only as the rotating band concept serves a completely different purpose than the three-component invention disclosed herein wherein an external band is used to lock a malleable core within a jacket.

SUMMARY OF THE INVENTION

According to an aspect of the disclosure, a bullet includes a malleable core having a section with a first end and a second end, a jacket comprising malleable material surrounding the malleable core, the jacket having a first end and a second end, and a locking band surrounding a portion of the jacket configured to retain the malleable core with the jacket during use, at least a portion of the locking band configured around a circumferential depression in a wall of the jacket and a mating circumferential depression in the malleable core.

According to another aspect of the disclosure, a method for manufacturing a bullet, includes forming an indention around a circumference of a jacket, forming an indention around a circumference of a malleable core within the jacket, and arranging a band in the indentation of the circumference of the jacket such that the jacket and malleable core are retained together with the band of material positioned within the indentation around the circumference of the jacket during impact at a desired velocity.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the invention, are incorporated in and constitute a part of this specification, illustrate embodiments of the invention, and together with the detailed description, serve to explain the principles of the invention. No attempt is made to show structural details of the invention in more detail than may be necessary for a fundamental understanding of the invention and the various ways in which it may be practiced. In the drawings.

DETAILED DESCRIPTION OF THE DISCLOSURE

Figure 1:
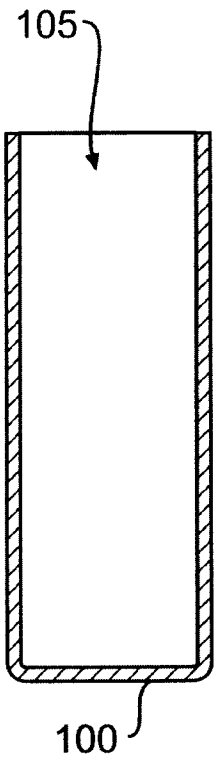
FIG. 1 is an exemplary illustration of an empty cylindrical metal jacket, configured according to principles of the disclosure.

The aspects of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

It is understood that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art to which this invention belongs. Preferred methods, devices, and materials are described, although any methods and materials similar or equivalent to those described herein can be used in the practice or testing of the invention.

The disclosure is generally directed to a three component bullet including a metal jacket, a malleable core and an externally situated metal locking band which is embedded in a portion of the outside of the jacket. Swaging the locking band in place forms an inward circumferential protrusion on the interior wall of the jacket which embeds itself in the malleable core which locks the core within the jacket. The jacket and core remain locked together even after the bullet is fired from a firearm and impacts hard barrier materials such as windshield glass, sheet steel or the like while retaining a large percentage of its original weight. This combination of elements allows the bullet to achieve post-barrier penetration of ballistic gelatin which exceeds 12 inches—the minimum depth called for in the FBI's Ballistic Test Protocol. In so doing, the bullet exhibits a terminally effective degree of expansion beyond its original diameter.

FIGS. 1-11 herein may be viewed as an overall sequence describing a first exemplary process performed according to principles of the disclosure for manufacturing a three-component bullet, the resulting three-component bullet configured according to principles of the disclosure. FIGS. 1-11 are each longitudinal cross-sectional views.

FIG. 1 is an exemplary illustration of an empty cylindrical metal jacket, configured according to principles of the disclosure, generally denoted by reference numeral 100. The cylindrical metal jacket may be drawn from a metal cup and trimmed to an appropriate length, and having an open end 105. The jacket 100 may be made from any suitable malleable material. The preferred materials are brass, gilding metal, copper and mild steel. The jacket 100 may be configured in size based on any intended caliber, such as .223, .243, .30-06, .357, .38, .40, .44, or 9 mm, for example only. However, nearly any caliber bullet may be produced using the principles of the disclosure.

Figure 2:
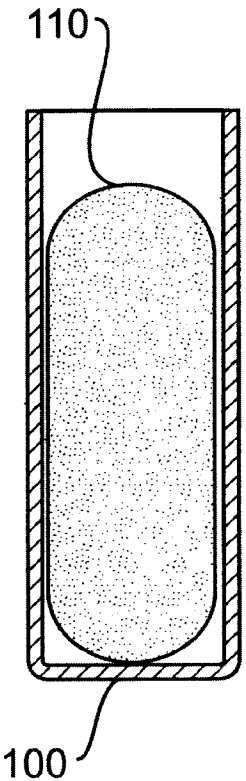
FIG. 2 is an exemplary illustration showing a malleable core which has been dropped into the cylindrical jacket shown in FIG. 1.

FIG. 2 is an exemplary illustration showing a malleable core which has been dropped into the cylindrical jacket shown in FIG. 1. At this point, the malleable core 110 is loose within the jacket 100. The malleable core 110 may be made from any suitable material. The preferred materials are pure lead and alloyed lead containing a percentage of antimony. Other materials are also contemplated.

Figure 3:
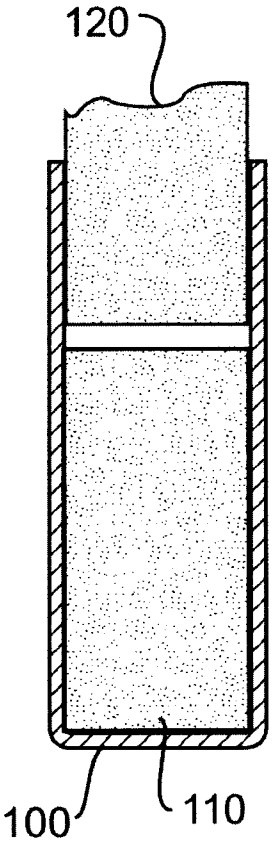
FIG. 3 is an exemplary illustration showing the cylindrical jacket and core of FIG. 2 after a seating punch has forcefully seated the core within the jacket.

FIG. 3 is an exemplary illustration showing the cylindrical jacket and core of FIG. 2 after a seating punch has forcefully seated the core within the jacket. This may be accomplished if the jacket 100 and core 110 are held in a substantially cylindrical die (not shown). In FIG. 3, the seating force has caused the core to shorten axially and expand radially. At this juncture, bottom and side surfaces of the core 110 are in intimate contact with the interior wall of the jacket 100. The jacket 100 and core 110 are securely coupled together and will remain so throughout the balance of the manufacturing steps. The seating punch 120 is shown retracting from the jacket after having seated the core 110 intimately with the jacket 100.

Figure 4:
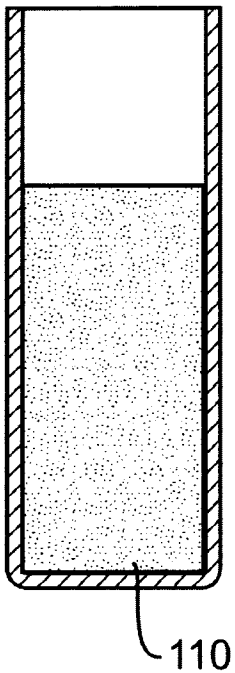
FIG. 4 is an exemplary illustration showing the cylindrical jacket with seated core of FIG. 3, after the seating punch has fully retracted.

FIG. 4 is an exemplary illustration showing the cylindrical jacket with seated core of FIG. 3, after the seating punch has fully retracted.

Figure 5:
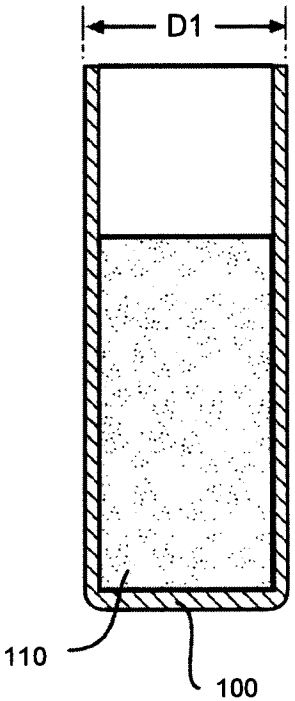
FIG. 5 is an exemplary illustration showing the cylindrical jacket with seated core of FIG. 4 (i.e., jacket/core assembly)

FIG. 5 is an exemplary illustration showing the cylindrical jacket with seated core of FIG. 4 (i.e., jacket/core assembly). During this process the jacket may be inverted, i.e., rotated 180° from its previous orientation in FIG. 4. However, it should be noted that the manufacture may be completed with any orientation. The diameter of the cylindrical jacket is shown designated as D1 along its entire length at this stage.

Figure 6:
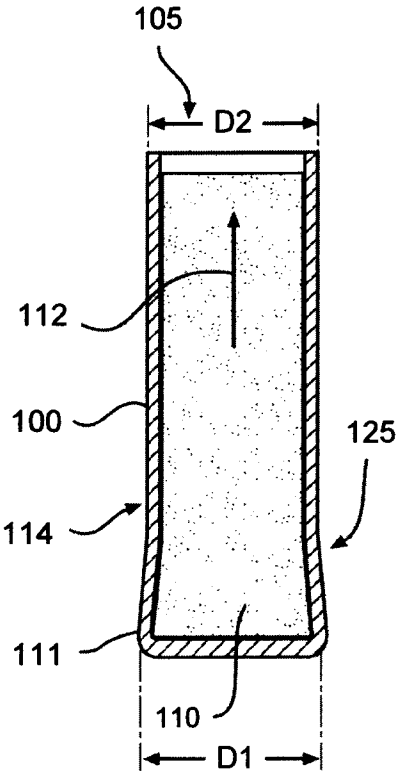
FIG. 6 is an exemplary illustration showing the jacket-core assembly of FIG. 5 after it has been forced into a bottleneck-shaped die (not shown) which has produced a bottleneck-shaped configuration.

FIG. 6 is an exemplary illustration showing the jacket-core assembly of FIG. 5 after it has been forced into a bottleneck-shaped die (not shown) which has produced a bottleneck-shaped configuration (hereafter, the "pre-form" 114). The open-mouthed front end of the pre-form 114 has been constricted inwardly along a length of the jacket 100, resulting in a smaller diameter D2 than the diameter D1 of its closed base end 111. The diameter at each opposite end of the pre-form is connected by a transition angle which forms a tapered shoulder 125. It should be noted, however, that in lieu of a transition angle, the diameter of each end of the pre-form can be connected by a radius. During the constriction process the core 110 is proportionally constricted as it is forced to assume the bottleneck-shaped geometry of the interior of the jacket wall. The subsequent volume reduction forces the malleable core 110 to flow forward, as represented by arrow 112, growing in length towards the open end 105 of the pre-form 114. The constriction action further tightens the seated core 110 within the jacket 100. Moreover, the tapered shoulder 125 further acts to lock the now expanded and re-formed core 110 in-place proximate the base 111.

Figure 7:
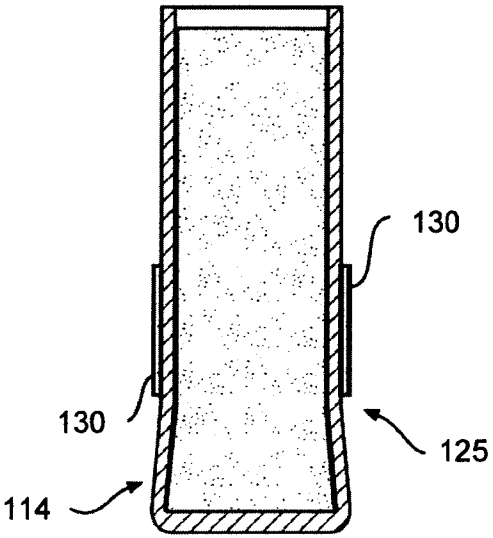
FIG. 7 is an exemplary illustration showing a locking band of appropriate height, diameter and wall thickness, engaging the pre-form of FIG. 6.

FIG. 7 is an exemplary illustration showing a locking band of appropriate height, diameter and wall thickness, engaging the pre-form of FIG. 6. The pre-form 114 and locking band 130 may be transferred to another die station containing a substantially cylindrical die (not shown). The locking band 130 may be fed under transfer fingers and the smaller, open end 105 of the pre-form 114 may be dropped through the locking band 130. When shouldered opposition is employed, such as a metal sleeve, the momentum generated by a free-falling pre-form 114 is sufficient to axially position the locking band 130 on the pre-form 114 with a high degree of accuracy from cycle to cycle.

The locking band 130 may be constructed from any suitable material. The preferred materials are brass, gilding metal, copper and mild steel. The metal used in the locking band 130 does not have to match the metal used in the jacket 100. If the metal used is steel, the steel locking band may be electroplated to resist corrosion using a thin coating of copper, zinc, brass, nickel or any other corrosion-resistant material as desired. The locking band 130 may also be anodized, dyed or otherwise colored for marketing purposes or color-coded for law enforcement use to distinguish one type of ammunition from another.

Metal locking bands may be manufactured by drawing long metal jackets and thereafter pinch-trimming individual band sections from the jacket or by cutting off multiple band sections of the same on a lathe using a stepped cutoff tool. As an alternative, the locking bands can be cut from metal tubing using a lathe.

As an alternative material, the locking band 130 may be made of a polymer. The preferred polymers are polycarbonate, Nylon™ and high density polyethylene. Polymer locking bands may be injection molded or cut to length on a lathe from tubing.

The locking band 130 may be constructed to have an axial wall height of between about 0.080 of an inch and 0.350 of an inch but the preferred height is between about 0.125 of an inch and 0.200 of an inch. The locking band 130 may be constructed to have a wall thickness of between about 0.009 of an inch and 0.045 of an inch, but the preferred wall thickness is between about 0.016 of an inch and 0.030 of an inch.

Figure 8:
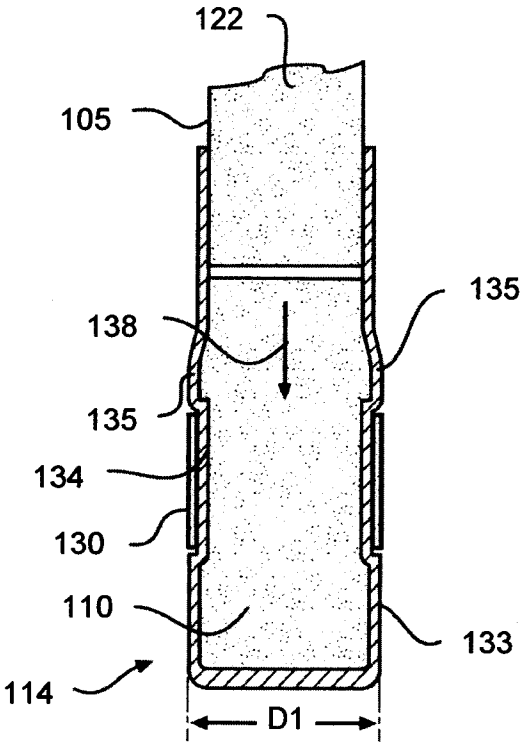
FIG. 8 is an exemplary illustration showing the pre-form and locking band arrangement of FIG. 7, and the internal locking feature created on the interior of the jacket after a seating punch has radially expanded both the malleable core and the jacket sufficiently to create a pronounced shoulder area in the jacket fore and aft of the locking band.

FIG. 8 is an exemplary illustration showing the pre-form and locking band arrangement of FIG. 7, and the internal locking feature created on the interior of the jacket after a seating punch has radially expanded both the malleable core and the jacket sufficiently to create a pronounced shoulder area in the jacket fore and aft of the locking band. In reference to FIG. 8, after a relatively tight-fitting seating punch 122 has entered the open mouth 105 of the jacket 100 and having generated sufficient axial force against the face of the metal core 110 to radially swell the core 110 and subsequently portions of the jacket 100 fore and aft of the locking band 130, thereby securing the locking band 130 in place while at the same time producing an inwardly-extending annular band 134 of jacket material which embeds itself into the core material 110 with the result that the core 110 is locked inside the jacket 100. The malleable core 110 now may generally resemble an hour-glass shape. During this seating-swelling process sufficient pressure is generated to radially expand the locking band outwardly as well with the result that the locking band 130 and the jacket portions fore 135 and aft 133 of the locking band 130 end up having substantially similar diameters. The seating punch is shown retracting from the jacket after having seated the core 110. The core-seating step has decreased, represented by arrow 138, the axial length of the core, resulting in more "air space" at the open end 105 of the jacket 100. The additional room gained in this open end 105 area is usually needed for subsequent jacket forming operations.

Figure 9:
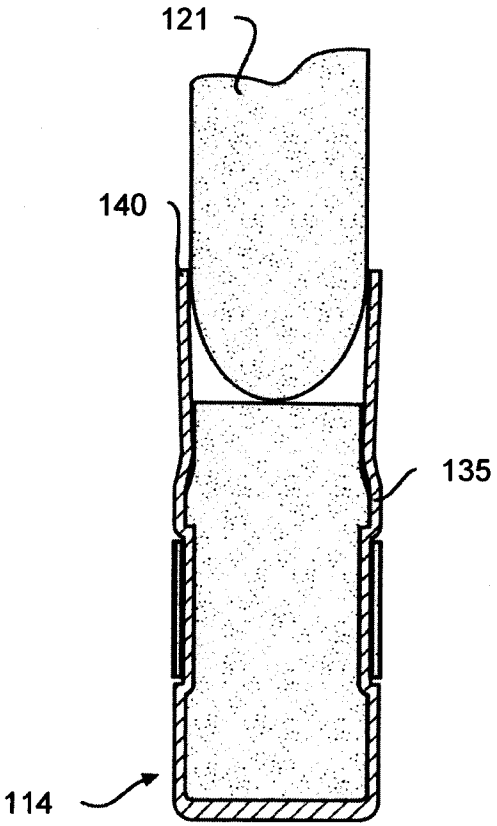
FIG. 9 is an illustration showing a belling punch entering and radially expanding the mouth of the pre-form shown in FIG. 8.

FIG. 9 is an illustration showing a belling punch entering and radially expanding the mouth of the pre-form shown in FIG. 8. The belling punch 121 may not contact or deform the core 110 in any way. Belling 140 (or expanding) the jacket mouth (i.e., at open end 105) to near-caliber diameter is done to prepare the jacket mouth so that it can be weakened in a subsequent step using a standard-diameter nose-cut die, notching die, or scoring die, for example. However, it should be understood that a smaller diameter nose-cut die could be utilized which would simplify the manufacturing procedure by eliminating the belling step shown in FIG. 9 altogether. This would allow one to go directly from the step represented by FIG. 8 to the step represented by FIG. 10 without materially affecting the cosmetic appearance of the final bullet.

Figure 10:
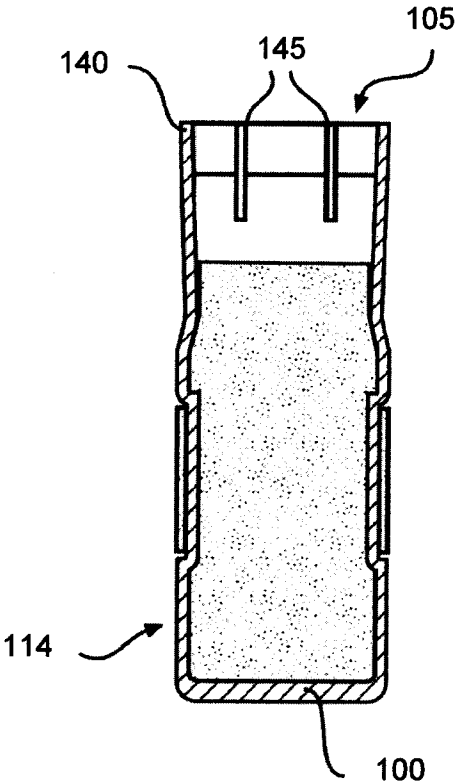
FIG. 10 is an exemplary illustration showing the pre-form of FIG. 9, after a nose-cut die (not shown) has configured jacket-weakening features in the jacket.

FIG. 10 is an exemplary illustration showing the pre-form of FIG. 9, after a nose-cut die (not shown) has configured jacket-weakening features in the jacket. It should be understood, however, that various jacket weakening features 145 may be applied to the jacket mouth 105 at this station, which may include axially spaced slits slanted slits, V-shaped notches, axial scores, and the like (or combinations thereof) in the mouth of the jacket. While a final bullet may be made without jacket-weakening features, it is desirable to include at least one of the jacket weakening features 145 mentioned above to ensure consistent and reliable expansion over a wide range of velocities in various mediums. The jacket weakening features 145 may form spaced petals.

Moreover, in one aspect, the jacket weakening features 145 may comprise a plurality of longitudinally projecting spaced slits 145 forming spaced petals therebetween having side edges extending through a front open end of the malleable core into a central recess to form petals of core material and jacket material between the spaced slits and wherein the jacket material extends into the slits to said central recess which permits the petals of core and jacket material to separate and form outwardly projecting petals.

Figure 11:
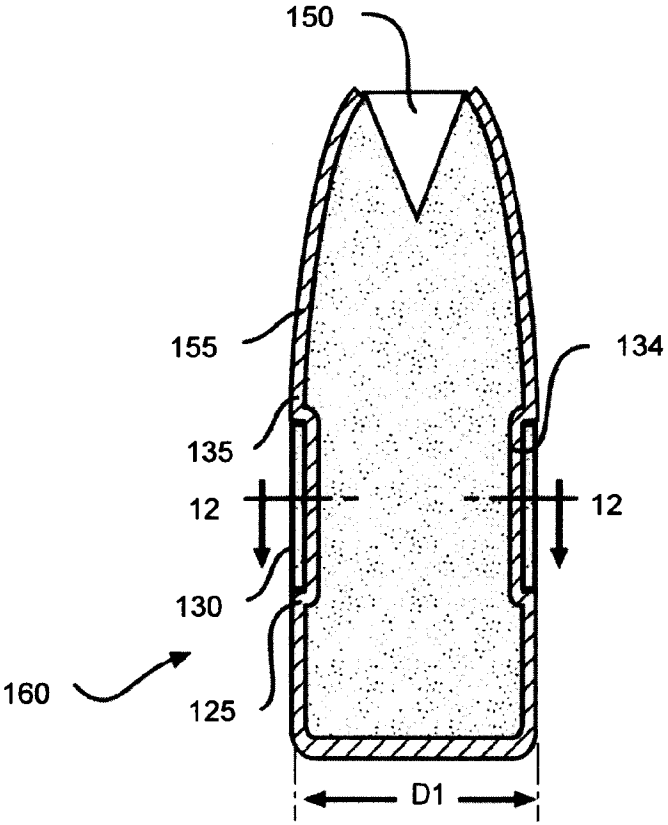
FIG. 11 is an exemplary illustration showing the pre-form of FIG. 10 after the pre-form is forced into a hollow point profile die.

FIG. 11 is an exemplary illustration showing the pre-form of FIG. 10 after the pre-form is forced into a hollow point profile die. The final form of the bullet 160 (i.e., a finished bullet) may or may not have a hollow point 150 in it its nose, depending on desired features. Other nose features are possible. Regardless of its final nose configuration, the locking band 130 feature retains the core 110 within the jacket 100 substantially 100% of the time whether the bullet 160 impacts a hard barrier material such as windshield glass or metal, or a soft target, at a desired velocity, e.g. high velocity. It should be noted that, while the preferred location of the locking band 130 is on the shank or bearing surface of the bullet as shown in FIG. 11, the front portion of the locking band 130 may, if desired, be positioned slightly forward of the shank area which would allow it to cover a portion of the bullet ogive 155. This would allow a portion of the locking band 130 and any distinctive color associated therewith to be fully visible in a loaded round of ammunition.

The 90° shoulder formed on the interior wall of the jacket proximate 134/135 in conjunction with the axial length and the radial depth of the circumferential depression coalesce to provide superior core-locking ability. The internal geometry derived from the use of a third component, i.e., an external locking band 130, is a principle factor that provides superior bullet core retention ability during impacts as compared with prior art bullets. However, other architectures for the circumferential depression are shown in the figures, described below, and/or contemplated by the invention.

Figure 12:
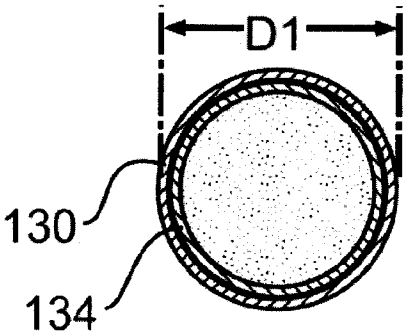
FIG. 12 is a cross-section taken at location 12 of FIG. 11.

FIG. 12 is a cross-section taken at location 12 of FIG. 11. The cross-section shows the diameter of the jacket 100 and band 130 at this cross-section location 12. The diameter of the jacket 100 being smaller than the diameter of the band 130 at this cross sectional location 12. However, the outer diameter of the band 130 is essentially similar to the outer diameter of the jacket 100 at other locations such as portions fore 135 and aft 133 of the locking band 130 (see, FIG. 8 and FIG. 11).

A modification to the manufacturing approach described in FIGS. 1 through 11 above reverses the location of the bottlenecking process. More specifically, the bottlenecking process shown with respect to FIGS. 6 and 7 may be reversed such that the diameter D1 at the base is made less than the diameter D2 at the open end 105. In that regard the band 130 may be inserted from the base end of jacket 100 instead of the open end 105. All other process steps with respect to FIGS. 1 to 11 described above may be substantially the same. The advantage to this reverse bottlenecking process is that most of the forward portion of the jacket 100, which is adjacent to the open end 105, does not get work hardened, the larger open end 105 may receive the core 110 more easily, and other advantages which are apparent from the description herein.

Yet another modification to the manufacturing approach to the invention includes the steps of taking the standard drawn jacket 100 without the core 110, forcing the jacket 100 into the bottleneck shape through the use of a bottleneck die without the core 110. Thereafter, attaching the band 130 over the jacket 114 from the open end 105 until it is positioned adjacent the larger diameter section of the jacket 100. Thereafter expanding the jacket 100 with an expander punch to expand the bottlenecked portion of the jacket 100 to increase the outside diameter thereof. Thereafter inserting the lead core 110. The core may then be seated as described with respect to FIGS. 1 through 11 above. Finally the bullet point may be formed in the bullet to provide its final shape. A further alternative process can also use the reversed bottleneck approach wherein the base of the bullet jacket 100 is reduced in diameter while the open end 105 is maintained at the original diameter. The advantages being that the more pronounced radius in the closed end of the jacket allows faster and more precise alignment of the band 130 in a high-speed production process; and the standard diameter core and/or standard diameter seating punch may be used in a process of this nature.

Yet another alternative modification to the manufacturing process may include point forming the base of the jacket 100 such that it has a greatly reduced diameter. The band 130 in this case may be placed on the jacket 100 base first. Thereafter the insertion of the core 120 is next performed on the bullet and the core 110 may be seated and manufactured a consistent with the FIGS. 1 through 11 above to provide the finalized bullet. The advantages of using the point formed jacket is that the radius on the closed end of the jacket allows faster more precise alignment of the band 130 in high-speed production environments; and the standard diameter core 110 and standard diameter seating punch may be used in such a process.

Figure 13:
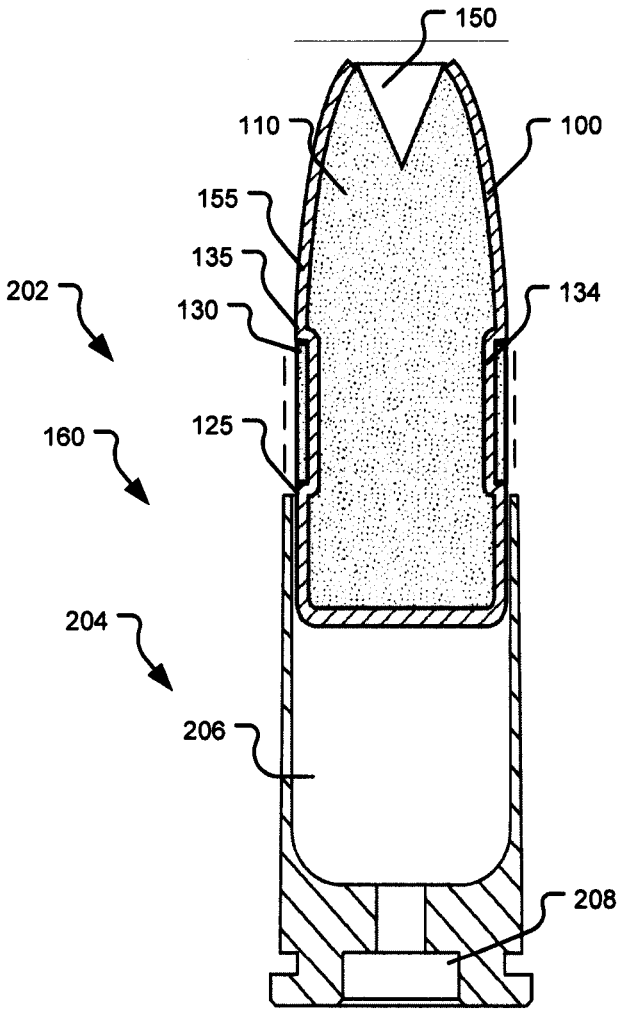
FIG. 13 is a view of a cartridge using the bullet of FIG. 11.

FIG. 13 is a view of a cartridge using the bullet of FIG. 11. In particular, as shown in FIG. 13, a round of ammunition 202 (e.g. a cartridge) for use in a firearm may be produced by employing the bullet 160 configured and produced according to the principles of the disclosure herein. The bullet 160 may be combined with an appropriate casing 204, propellant charge 206, flash hole (not numbered), primer pocket (not numbered), and primer 208, for example, to produce a round of ammunition. Note that the casing 204 is dashed to show that any length of the casing is contemplated by the invention. The length of casing may expose, partially cover, or fully cover the band 130.

Figure 14:
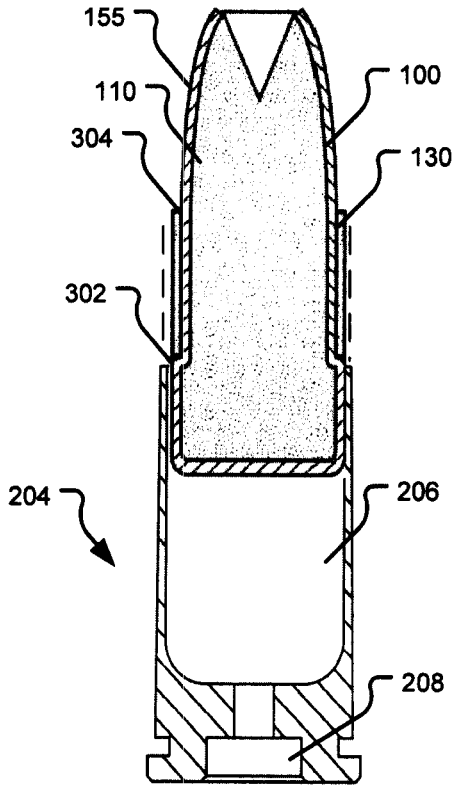
FIG. 14 is another aspect of the bullet loaded in a cartridge and configured according to principles of the disclosure.

FIG. 14 is another aspect of the bullet loaded in a cartridge and configured according to principles of the disclosure. In particular FIG. 14 the band 130 may be held to the jacket 100 through only a single indentation edge 302. In that regard, as shown in FIG. 14 the portion 304 of the bullet does not have an increased radius as shown with respect to the bullet of FIG. 13. Accordingly, this configuration is such that the core 110 is trapped at only the base end through the edge 302.

Figure 15:
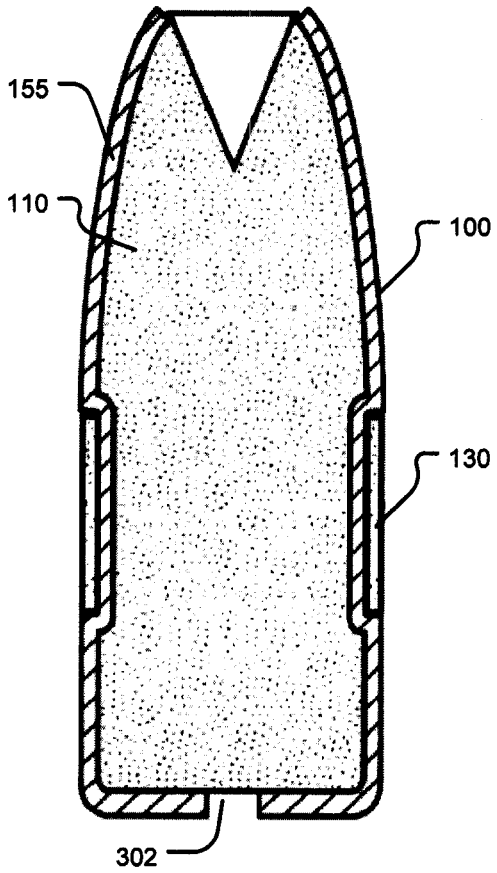
FIG. 15 is another aspect of the bullet with a perforated base configured according to principles of the disclosure.

FIG. 15 is another aspect of the bullet with a perforated base configured according to principles of the disclosure. In particular, FIG. 15 shows another configuration of a bullet wherein the jacket 100 of the bullet includes a perforated base portion 302. The perforation 302 may be formed during the manufacturing process consistent with the processes described above. The jacket shown in FIG. 15 may also be formed from metal tubing which is open at both ends. Alternatively, the perforation may be part of the original preformed jacket 114.

Figure 16:
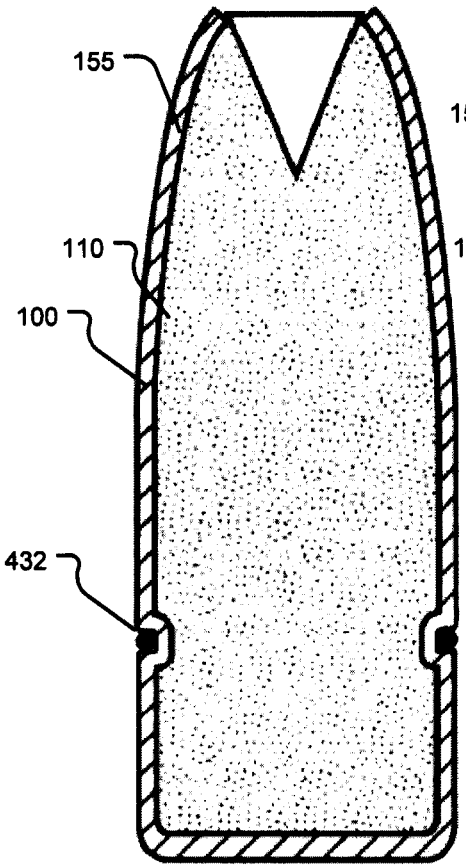
FIG. 16 is another aspect of the bullet having a wire band configured according to principles of the disclosure.
Figure 17:
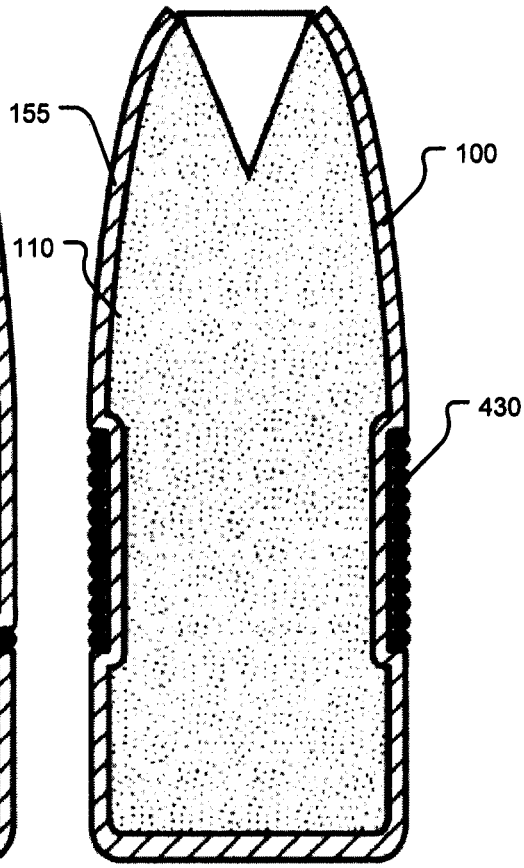
FIG. 17 is another aspect of the bullet having a wire band configured according to principles of the disclosure having a helically-coiled wire band.

FIG. 16 is another aspect of the bullet having a wire band configured according to principles of the disclosure; and FIG. 17 is another aspect of the bullet having a wire band configured according to principles of the disclosure. In particular, FIGS. 16 and 17 show a band 432 and 430 that is formed of coiled wire. More specifically, during the manufacturing process of the bullet in FIG. 16, instead of inserting a cylinder-shaped band 130 during the manufacturing process described above, a single wire 432 shaped band may be used and the band may be wrapped around the bullet in order to provide the same functionality as described with respect to the band 130. Similarly, as shown in FIG. 17 multiple coils of wire may be attached to the bullet 430 to provide the same functionality as the band 130 previously described. In either case, the wires 432 or 430 may be formed in a ring and their ends welded or the wire may be wrapped a number of times in a spiral fashion to form the coil construction. Any type of wire arrangement to produce the wire coil 432, 430 is contemplated by the invention herein.

Figure 18:
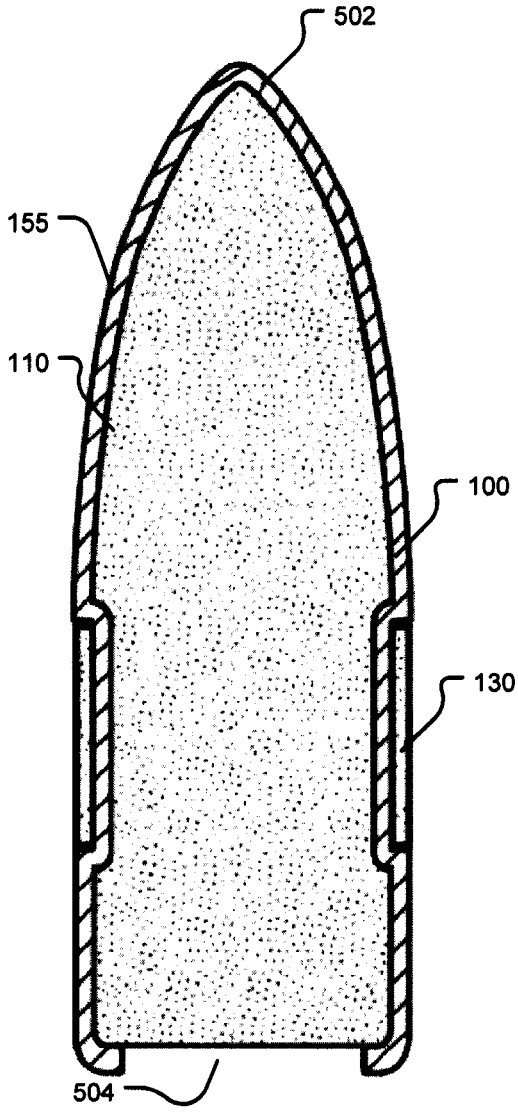
FIG. 18 is another aspect of the bullet having a closed nose configured according to principles of the disclosure.

FIG. 18 is another aspect of the bullet having a closed nose configured according to principles of the disclosure. In particular, FIG. 18 shows a bullet having a closed tip 502. In that regard, the jacket 100 may be constructed consistent with the process of FIGS. 1-11 except that the tip is formed from the base and is hence closed prior to performing the substantial manufacturing steps described above. Moreover, in this aspect of the invention, the base of the bullet may include an open end 504. The process of manufacturing noted above can be used with this modification and is within the scope and sphere of the invention.

Figure 19:
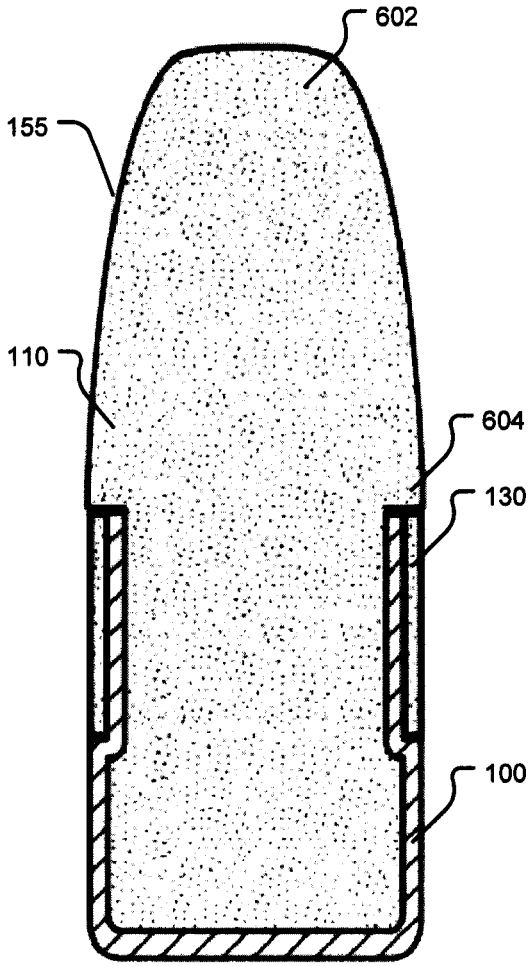
FIG. 19 is another aspect of the bullet having a lead nose configured according to principles of the disclosure.

FIG. 19 is another aspect of the bullet having a lead nose configured according to principles of the disclosure. In particular, FIG. 19 shows an aspect wherein the bullet has a lead nose 602 with no jacket located in this area. In this regard, the jacket 100 has a substantially reduced size and does not extend to the nose area. Moreover, the lead core 110 may include an edge portion 604 to help maintain the jacket 100 in association with the remaining part of the bullet core 110.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications or modifications of the invention.

What is claimed is:

1. A bullet comprising:

a malleable core having a section with a first end and a second end;

a jacket comprising malleable material surrounding the malleable core, the jacket having a first end and a second end, a wall, and an inwardly extending annular band embedded into the malleable core and forming a circumferential depression in the wall of the jacket, and which forms a mating circumferential depression in the malleable core; and a locking band surrounding a portion of the jacket configured to retain the malleable core with the jacket during use; and wherein the locking band is engaged between shoulders defined in the jacket fore and aft of the locking band, and wherein the locking band and jacket are subjected to swelling so as to radially expand the jacket and locking band so that the locking band is compressively engaged within the circumferential depression in the wall of the jacket, the shoulders of the jacket being in compressive engagement with the locking band.

2. The bullet of claim 1, wherein the circumferential depression in the wall is circumferentially embedded in circumferential depression of the malleable core.

3. The bullet of claim 1, wherein the malleable core has a central recess in the first end of the core.

4. The bullet of claim 1, wherein the locking band is metal.

5. The bullet of claim 4, wherein the metal of the locking band comprises at least one of copper, gilding metal, brass and steel.

6. The bullet of claim 1, wherein the locking band is a polymer.

7. The bullet of claim 6, wherein the polymer of the locking band comprises at least one of polycarbonate, polyamide, and high density polyethylene.

8. The bullet of claim 1, wherein an outside diameter of the locking band has a greater diameter than the outside diameter of the outermost portion of the bullet jacket.

9. The bullet of claim 1, wherein an outside diameter of the locking band has a smaller diameter than the outside diameter of the outermost portion of the bullet jacket.

10. The bullet of claim 1, wherein the first end comprises a bullet tip and the second end comprises a bullet base and the bullet base is open-ended.

11. The bullet of claim 1, wherein the first end comprises a bullet tip and the second end comprises a bullet base and the bullet base is closed.

12. The bullet of claim 1, wherein the circumferential depression in a wall of the jacket comprises one of a groove having upper and lower edges, a single edge, and a reduced diameter portion.

13. The bullet of claim 1, further comprising jacket weakening features configured in the first end of the jacket.

14. The bullet of claim 13, wherein the jacket weakening features comprise a plurality of longitudinally projecting spaced slits forming spaced petals.

15. A cartridge comprising the bullet of claim 1.

16. A bullet comprising:

a malleable core having a first end and a second end;

a jacket surrounding the core and comprising a wall, a first and a second end, and a circumferential depression formed in the wall and which forms a mating circumferential depression in the malleable core; and a locking band comprising an upper side and a lower side that are compressively engaged within the circumferential depression formed within the wall of the jacket to retain the core within the jacket and assist in controlling expansion of the jacket and malleable core, and wherein an outside diameter of the locking band is substantially the same diameter as an outside diameter of the outermost portion of the jacket.

17. A method for manufacturing a bullet, comprising:

arranging a band of material about a circumference of a jacket containing a malleable core; and forming an indention around a circumference of the jacket by holding the band of material around the circumference of the jacket while compressing the malleable core within the jacket and forming at least one shoulder by pressing the malleable core outwardly proximate the band of material wherein the jacket and malleable core are retained together with the band of material positioned within the indentation around the circumference of the jacket during impact at a desired velocity.

18. The method of claim 17, wherein the malleable core has a diameter at one or more locations, above or below the indention, greater than the diameter of the jacket at the indention, thereby assisting locking the core to the jacket.

19. The method of claim 17, further comprising the step of forming a smaller circumference in a portion of a length of the jacket.

20. The method of claim 19, wherein the step of forming a smaller circumference is preformed with the malleable core within the jacket, locking the malleable core in place at one end.

21. The method of claim 17, further comprising configuring jacket weakening features in a first end of the jacket.

22. The method of claim 17, further comprising forming petals in the first end of the jacket and the core.

23. A cartridge comprising the bullet produced by the method of claim 17.

24. A bullet, comprising:

a jacket formed from a malleable material and having a first end, a second end and a side wall defining an internal cavity;

a malleable core received and seated within the internal cavity of the jacket, with the core being expanded into coupling engagement with the side wall of the jacket; and a locking band comprising a polymer and applied about a portion of the jacket spaced between the first and second ends thereof;

wherein the locking band comprises fore and aft side edges that are compressively engaged between fore and aft shoulders of a circumferential depression formed in the side wall of the jacket and projecting onto the core created by expansion of the malleable core and jacket to assist in controlling expansion of the jacket and the malleable core and retention of the malleable core with the jacket.

25. The bullet of claim 24, wherein the polymer of the locking band comprises at least one of polycarbonate, polyamide, and high density polyethylene.

26. The bullet of claim 24, wherein an outside diameter of the locking band is substantially the same diameter as an outside diameter of the outermost portion of the jacket in final assembly.

27. The bullet of claim 24, further comprising jacket weakening features configured in the first end of the jacket, and wherein the jacket weakening features comprise a plurality of longitudinally projecting spaced slits forming spaced petals.

* * * * *